United States Patent [19]

Deaven

[11] 4,120,025

[45] Oct. 10, 1978

[54] PORTABLE CONTAINER CONVERTIBLE TO LIGHTED DANCING STAGE

[76] Inventor: John B. Deaven, 5217 3/4 Virginia Ave., Hollywood, Calif. 90029

[21] Appl. No.: 831,780

[22] Filed: Sep. 9, 1977

[51] Int. Cl.[2] ..... F21S 1/02

[52] U.S. Cl. ..... 362/153; 362/154; 362/362; 362/382

[58] Field of Search ..... 362/362, 153, 382, 145, 362/154

[56] References Cited

U.S. PATENT DOCUMENTS 1,141,122 6/1915 Kliegel ..... 362/153

*Primary Examiner*—Stephen J. Lechert, Jr.

*Attorney, Agent, or Firm*—Harris, Kern, Wallen & Tinsley

[57] ABSTRACT

A portable container convertible to a lighted dancing stage, including a bottom panel adapted to lie flat and form a dancing stage, four side panels hingedly connected to the bottom panel along corresponding edges thereof and adapted to be folded upwardly to form a container, or to lie flat adjacent the bottom panel, readily releasable means for latching the side panels in their upwardly folded positions, and illuminating means carried by one of the side panels for directing light toward the bottom panel when the side panel which carries the illuminating means lies flat adjacent the bottom panel.

4 Claims, 4 Drawing Figures

PORTABLE CONTAINER CONVERTIBLE TO LIGHTED DANCING STAGE

BACKGROUND OF INVENTION

The present invention relates in general to a portable container, or other structure, which is convertible to a lighted dancing stage and, more particularly, to a portable container, or the like, comprising a bottom panel adapted to lie flat on a floor, or other supporting surface, four side panels hingedly connected to the bottom panel along corresponding edges thereof and adapted to be folded upwardly to form a container, or to lie flat adjacent the bottom panel, and readily releasable means for latching the side panels in their upwardly folded positions.

Relevant prior art comprises the following U.S. Pat. Nos.

465,438, Trouard
1,121,422, Tydings
1,164,668, Stancic
1,306,338, Hirlinger
1,308,682, Ritchie
1,324,313, Johnston
2,136,762, Simmons

SUMMARY AND OBJECTS OF INVENTION

The invention may be summarized as comprising, and the primary object of the invention is to provide, a portable container or other structure, convertible to a lighted dancing stage, and including a bottom panel capable of serving as a dancing stage, another panel hingedly connected to the bottom panel, and illuminating means carried by the other panel for directing light toward the bottom panel, and upwardly toward a performer thereon, when the other panel lies flat adjacent the bottom panel.

The invention may be further summarized as including, and an important object is to provide a portable container, or the like, convertible to a lighted dancing stage, including: a bottom panel adapted to lie flat on a floor or the like, and form a dancing stage; four side panels hingedly connected to the bottom panel along corresponding edges thereof and adapted to be folded upwardly to form a container, or to lie flat adjacent the bottom panel; readily releasable means for latching the side panels in their upwardly folded positions; and illuminating means carried by one of the side panels for directing light toward the bottom panel and upwardly toward a performer thereon, when said one side panel lies flat adjacent the bottom panel.

Another object is to provide a frame hinged to the inner surface of said one side panel and capable of pivoting downwardly and outwardly in response to the action of gravity upon downward pivoting of said one side panel relative to the bottom panel, the illuminating means being carried by such frame.

Another object is to provide a foot-operated switch means carried by the frame mentioned and adapted to energize the illuminating means.

Considering the utility of the invention, the aforementioned portable container, or similar structure, may be used as a prop by a performer who may conclude his act by converting the container into a lighted stage for a dancing routine, such as tap dancing, constituting the concluding segment of his act. The container can be almost anything and may have any suitable configuration, so long as it comprises basically a bottom panel serving as a dancing floor and another panel hingedly connected to the bottom panel and carrying illuminating means.

The foregoing objects, advantages, features and results of the present invention, together with various other objects, advantages, features and results thereof which will be evident to those skilled in the art to which the invention relates in the light of this disclosure, may be achieved with the exemplary embodiment of the invention illustrated in the accompanying drawing and described in detail hereinafter.

DESCRIPTION OF EXEMPLARY EMBODIMENT OF INVENTION

Figure 1:
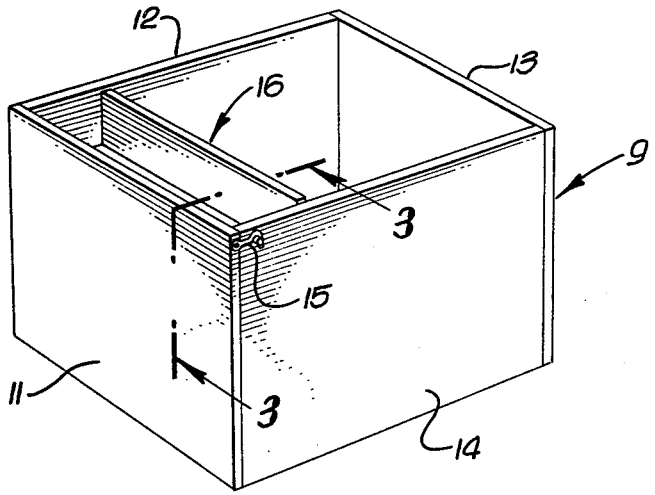
FIG. 1 is a perspective view of a portable container of the invention which is convertible to a lighted dancing stage.

Referring to the drawing, illustrated therein is a portable container of the invention which is shown as comprising simply a box 9 having a bottom panel 10 to the edges of which are hinged side panels 11, 12, 13 and 14 by means of hinges 19. As shown in FIG. 1, the side panels 11, 12, 13 and 14 are positioned vertically to form the box 9. The side panels 11 and 14 are releasably secured together by a hook 15, and the side panels 12 and 13 are similarly secured by another hook, not shown. These two hooks form a readily releasable means for latching the side panels 11, 12, 13 and 14 in their upwardly folded positions, wherein they cooperate with the bottom panel 10 to form the box-like container 9.

Figure 2:
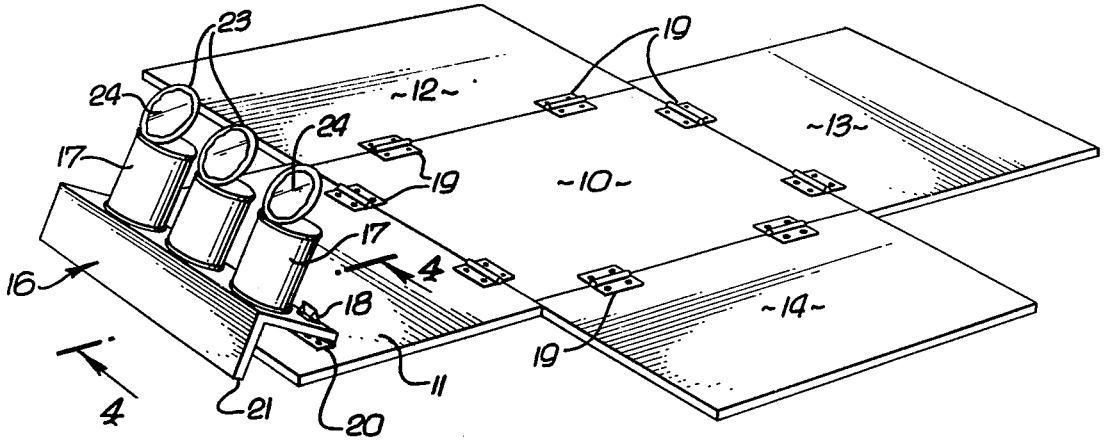
FIG. 2 is a perspective view showing the portable container of FIG. 1 unfolded and converted to a lighted dancing stage.

By releasing the hook 15, and its diagonally opposite counterpart, the panels 11, 12, 13 and 14 swing downwardly adjacent the bottom panel 10 and lie flat on the floor, or other supporting surface, to form a dancing stage, as shown in FIG. 2 of the drawing. If desired, the hinges 19 may be recessed into the panels 10, 11, 13 and 14, and may be of the type which permits them to be flush with the upper surfaces of the panels.

Hinged to the inner surface of the front side panel 11, by hinges 20 located below the upper edge of the panel 11, is an L-shaped frame 16 which assumes the position shown in FIGS. 1 and 3 when the structure of the invention is in its container configuration, and which falls forwardly into the position shown in FIGS. 2 and 4 when the structure assumes its dance floor or dancing stage configuration. As will be apparent from FIG. 4, one edge 21 of the L-shaped frame 16 rests on the floor, not shown, on which the panels 10, 11, 12, 13 and 14 lie.

The frame 16 carries light sources 17 which are powered by a battery or batteries, now shown, and which are actuable by a foot-operated switch 18 carried by the frame 16. The light sources 17 may be simple cans containing light bulbs 22 and having their lids 23 bent upwardly as shown. The central portions of the lids 23 may be removed and covered by sheets 24 of differently-colored translucent materials. The result is a multicolored lighting effect which is directed generally toward the dancing stage 10 and upwardly toward the body of the performer.

Figure 3:
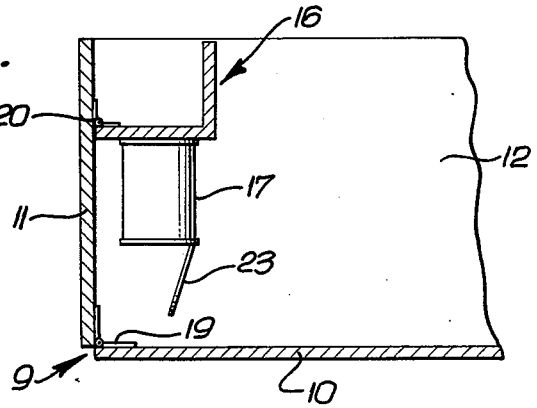
FIG. 3 is a fragmentary sectional view taken as indicated by the arrowed line 3—3 of FIG. 1.
Figure 4:
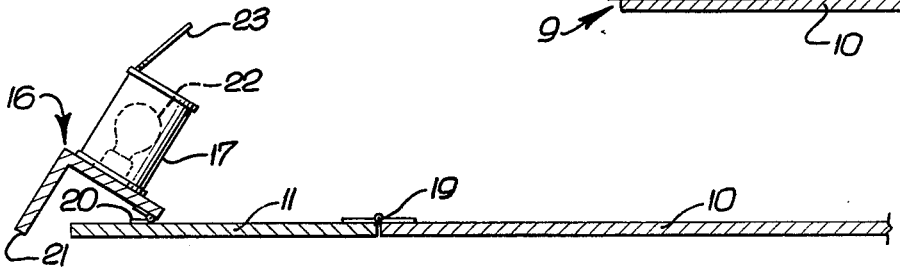
FIG. 4 is a fragmentary sectional view taken as indicated by the arrowed line 4—4 of FIG. 2 of the drawing.

In using the invention, the performer appears carrying the box 9, in the condition of FIGS. 1 and 3, filled with suitable props. These props are removed from the box 9 during the initial portions of the act. As a finale, the performer releases the hook 15, and its diagonally-opposite counterpart, whereupon the panels 11, 12, 13 and 14 fall downwardly to form, with the bottom panel 10, a flat dancing floor or stage. At the same time, the frame 16 falls forwardly to expose the light sources 17. At that point, the performer activates the switch 18 to energize the lights, and goes into his closing dance routine.

While a simple box 9 has been shown for illustrative purposes, it will be understood that the basic principles can be incorporated in other objects having similarly interconnected components corresponding at least approximately to the components disclosed.

Although an exemplary embodiment of the invention has been disclosed for illustrative purposes, it will be understood that various changes, modifications and substitutions may be incorporated in that embodiment without departing from the invention as hereinafter claimed.

I claim:

1. A portable structure convertible to a lighted dancing stage, including:

(a) a bottom panel adapted to lie flat and form a dancing stage;

(b) another panel hingedly connected to said bottom panel; and (c) illuminating means carried by said other panel for directing light toward said bottom panel when said other panel lies flat adjacent said bottom panel.

2. A portable container convertible to a lighted dancing stage, including:

(a) a bottom panel adapted to lie flat and form a dancing stage;

(b) four side panels hingedly connected to said bottom panel along corresponding edges thereof and adapted to be folded upwardly to form a container, or to lie flat adjacent said bottom panel;

(c) readily releasable means for latching said side panels in their upwardly folded positions; and (d) illuminating means carried by one of said side panels for directing light toward said bottom panel when said one side panel lies flat adjacent said bottom panel.

3. The container set forth in claim 2 including a frame hinged to the inner surface of said one side panel and capable of pivoting downwardly and outwardly in response to the action of gravity upon downward pivoting of said one side panel relative to said bottom panel, said illuminating means being carried by said frame.

4. The container defined in claim 3 including foot-operated switch means carried by frame for energizing said illuminating means.

* * * * *